US006448550B1

(12) United States Patent
Nishimura

(10) Patent No.: US 6,448,550 B1
(45) Date of Patent: Sep. 10, 2002

(54) METHOD AND APPARATUS FOR MEASURING SPECTRAL CONTENT OF LED LIGHT SOURCE AND CONTROL THEREOF

(75) Inventor: Ken A. Nishimura, Fremont, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/560,718

(22) Filed: Apr. 27, 2000

(51) Int. Cl.[7] ..... H01J 5/16
(52) U.S. Cl. ..... 250/226; 250/216; 250/211
(58) Field of Search ..... 250/226, 216, 250/211, 239, 361

(56) References Cited

U.S. PATENT DOCUMENTS 4,716,285 A * 12/1987 Konishi ..... 250/205
6,122,042 A * 9/2000 Wunderman et al. ..... 356/343

* cited by examiner

*Primary Examiner*—David V. Bruce
*Assistant Examiner*—Pamela R. Hobden
(74) *Attorney, Agent, or Firm*—Robert T. Martin

(57) ABSTRACT

Solid state illumination using closed loop spectral control. Light emitting diodes producing different colors are mounted in close proximity to photosensors. Spectral content of the light emitting diodes is measured by the photosensors, and these measurements used to adjust light emitting diode currents to achieve the desired spectral characteristics.

22 Claims, 4 Drawing Sheets

METHOD AND APPARATUS FOR MEASURING SPECTRAL CONTENT OF LED LIGHT SOURCE AND CONTROL THEREOF

BACKGROUND OF THE INVENTION

1. Field of the Invention

The present invention pertains to the field of solid state illumination, and more particularly to solid state illumination systems employing closed loop control to maintain spectral characteristics.

2. Art Background

High brightness Light Emitting Diodes (LEDs) have sparked interest in their use for illumination. LEDs have no moving parts, operate at low temperatures, and exceed the reliability and life expectancy of common incandescent light bulbs by at least an order of magnitude. The main drawback in implementing LED based light sources for general illumination purposes is the lack of a convenient white-light source. Unlike incandescent light sources which are broadband black-body radiators, LEDs produce light of relatively narrow spectra, governed by the bandgap of the semiconductor material used to fabricate the device. One way of making a white light source using LEDs combines red, green, and blue LEDs to produce white, much in the same way white light is produced on the screen of a color television.

Combining light from blue, red, and green LEDs of appropriate brightness yields a "white" light. The brightness of each LED is controlled by varying the amount of current passing through it. Slight differences in the relative amounts of each color manifests itself as a color shift in the light, akin to a shift in the color temperature of an incandescent light source by changing the operating temperature. Use of LEDs to replace existing light sources requires that the color temperature of the light be controlled and constant over the lifetime of the unit.

Some applications require more careful control of spectral content than others, and differing color temperatures may be desired for different applications. For example, spectral control is of extreme interest in applications such as lighting of cosmetics counters, and food outlets, while spectral control may not be critical in industrial lighting applications where reliability is more important.

There are two effects which make careful control of spectral content difficult. First is that the luminous efficiency of a given LED will not exactly match that of another LED manufactured by a nominally identical process. The second is that the luminous efficiency of a given LED, and its spectral content, may shift over the lifetime of the device.

The first problem may be addressed by testing, grading, and matching devices during manufacture. This testing is expensive, and does not address changes occurring with device aging.

What is needed is a method of automatically measuring the spectral content of a LED light source, and controlling the spectral content based on that measurement.

SUMMARY OF THE INVENTION

Spectral content of a solid state illumination source composed of Light Emitting Diode (LED) sources of different colors is measured by photosensors mounted in close proximity to the sources. The results of these measurements are used to control the spectral content by varying the current to the different color LEDs.

BRIEF DESCRIPTION OF THE DRAWINGS

The present invention is described with respect to particular exemplary embodiments thereof and reference is made to the drawings in which.

DETAILED DESCRIPTION

Figure 1:
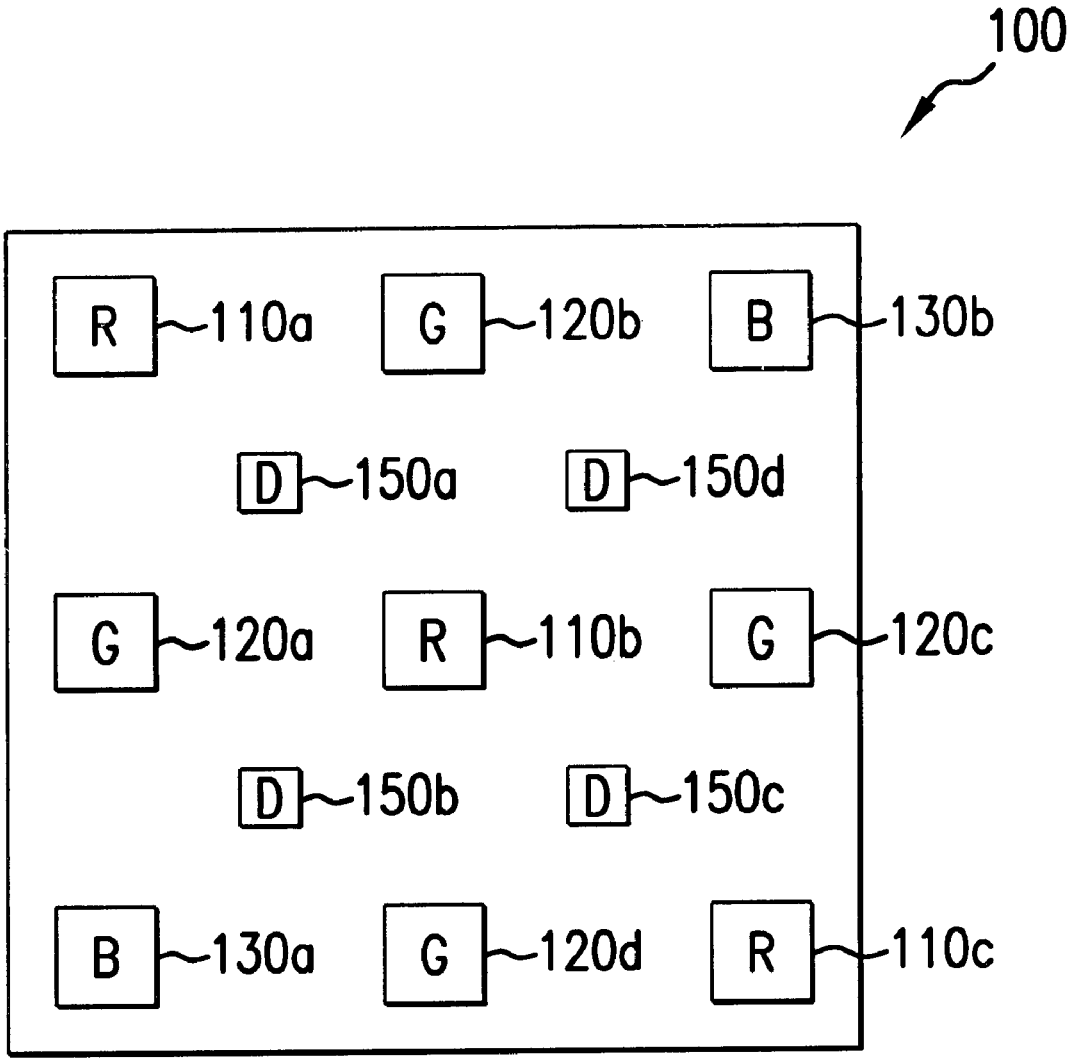
FIG. 1 shows the layout of a solid state illumination device according to the present invention.

FIG. 1 shows the layout of a solid state illumination device according to the present invention. While mounting LEDs and photosensors on the same substrate may increase manufacturing efficiency, such co-mounting is not necessary to practice the instant invention. Common substrate 100 holds light emitting diodes of different colors, and sensors for sensing emitted light. In this embodiment photodiodes are preferred, although any electrical device which produces a predictable varying electrical response to illumination may be used. In FIG. 1, LEDs of three colors, red (110*a*, 110*b*, 110*c*) green (120*a*, 120*b*, 120*c*, 120*d*) and blue (130*a*, 130*b*) are mounted on the substrate, along with photosensors 150*a*, 150*b*, 150*c*, and 150*d*. Photosensors 150 are interspersed between LED chips 110, 120, 130 to collect "averaged" light. Incident light on photosensors 150 is mainly via scattering, and is relatively well mixed. Any layout which allows for the photosensors to collect incident light from the LEDs is acceptable .

A common substrate may also used to provide interconnections between the devices and control circuitry. In mounting the devices on the substrate, the substrate may be used to provide a common terminal (anode or cathode) with the devices mounted thereupon. It may be advantageous to use the substrate as a common terminal so as to reduce the number of connections. In some circumstances it may be advantageous to separate out the connections between LEDs 110, 120, 130 and photosensors 150, so that the relatively large currents flowing through LEDs 110, 120, 130 do not interfere with the ability to measure the relatively small currents from photosensors 150.

The number and arrangement of LED chips and sensor chips is determined to a great extent by the light output of the LEDs, and the light output needed. Given efficient and powerful enough LEDs, only one of each color would be needed. The photosensors are interspersed among the LED chips to collect averaged light.

When photodiodes are used as photosensors 150, as in the preferred embodiment, they may be collected in parallel allowing automatic summation of the signals from each photodiode.

In operation, a desired spectral content is selected. This may be done in terms of equivalent color temperature. The spectral content of the operating set of LEDs is measured, and adjusted to match the desired levels.

In a first method of measuring spectral content, a calibration cycle is used in which the light flux of each LED color is measured and adjusted. In this method, photosensors 150 have useful and known response over the spectral range required. Each color of LED is illuminated independently for a brief period of time. The light output is measured by photosensors 150, compared to the desired level, and the current flowing through the selected LED adjusted accordingly. This method may be implemented using a single photosensor positioned so as to collect incident light from the LEDs. In the second, preferred method, uses color filters over photosensors 150. In this embodiment, a first pair of sensors, for example photosensors 150*a* and 150*c*, are covered with color filters which preferentially passes the shorter wavelengths, green through blue. Photosensors 150*b* and 150*d* are covered with color filters preferentially passing the longer wavelengths, green through red. Note that in this scheme, the passbands of each of the filters includes the green component. Alternatively, a separate channel with a green filter could be used. Note that when photosensors incorporating color filters are used, only those photosensors with similar filters are connected in parallel. In the example embodiment given, photosensors 150*a* and 150*c* would be connected in parallel, and photosensors 150*b* and 150*d* would be connected in parallel. In the embodiment using two channels, the proper color temperature is indicated by a set ratio between the outputs of the short and long wavelength sensors. The drive currents to the LEDs are adjusted to achieve the desired ratio. The overall device intensity is controlled by adjusting LED currents so that the sum of the signals from the short and long wavelength sensors equals a desired value.

The control circuit for the LED-sensor array may be a separate integrated circuit or circuits, and may be integrated onto the same substrate, or placed in separate packages.

In the preferred embodiment, the control circuit consists of integrators connected to each set of photodiodes; in this case, an integrator for the short wavelength sensors, and an integrator for the long wavelength sensors. These integrators convert photodiode current into a voltage representing the amount of light in that part of the spectrum. The voltage output of each integrator is fed to a window comparator. The purpose of the window comparator is to compare the input signal to a reference, and produce outputs when the input signal differs from reference by more than a specified amount of hysteresis. The reference is provided by an additional digital to analog converter (DAC). The gated outputs of the comparators are fed to up/down counters, which drive digital to analog converters. The digital to analog converters in turn control drivers for the LEDs.

Figure 2:
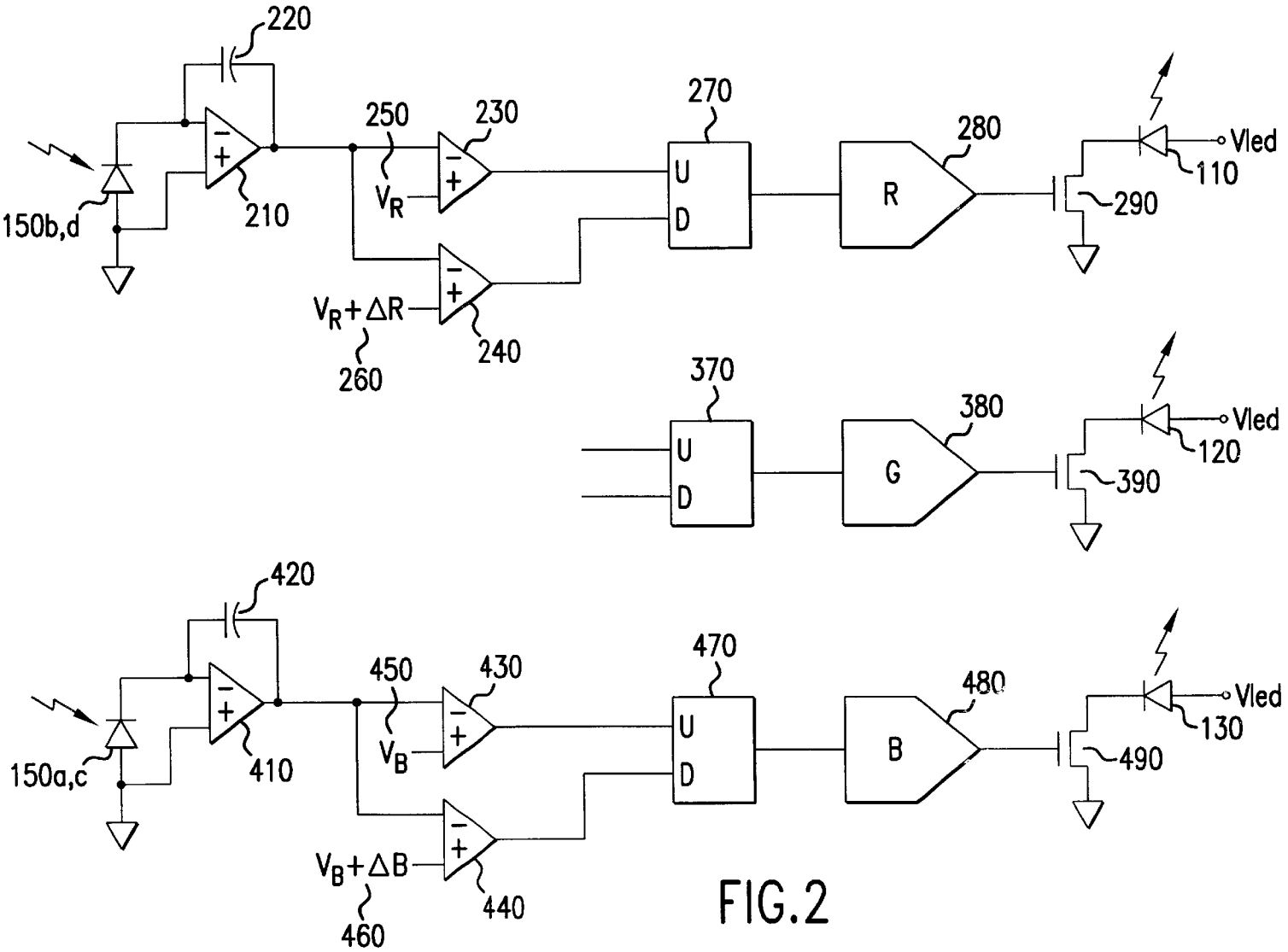
FIG. 2 shows the block diagram of an embodiment for the control circuit.

This is shown in simplified form in FIG. 2. Common circuitry such as initialization, gating, and clocking is not shown. Examining the red channel, photodiodes 150*b*, d of FIG. 1 feeds op amp 210 which uses capacitor 220 to form an integrator. The output of the integrator, a voltage representing the amount of light flux from filtered photodiodes 150*b,d*, feeds comparators 230 and 240. The output of comparator 230 will be high if the output of integrator 210 is below reference voltage VR 250, the desired red level. Similarly, the output of comparator 240 will be high if the output of integrator 210 is higher than reference voltage VR+ΔR 260. Reference levels VR 250 and VR+ΔR 260 are provided by an additional digital to analog converter, not shown. The outputs of comparators 230 and 240 feed up/down counter 270. The output of counter 270 feeds digital to analog converter (DAC) 280, which feeds driver 290, controlling the intensity of red LED 110. While a field effect transistor (FET) is shown for driver 290, bipolar transistors may also be used.

When the desired red light flux is below the desired level set by reference VR 250, the output of comparator 230 will be high. Counter 270 counts up, increasing the value feeding DAC 280, increasing the voltage on the gate of driver 290, and increasing the brightness of LED 110.

Similarly, if the desired red light flux is above the desired level set by reference VR+ΔR 260, the output of comparator 240 is high, causing counter 270 to count down. This decreases the value sent to DAC 280, decreasing the voltage on the gate of driver 290, and decreasing the brightness of LED 110.

The difference between reference voltages VR 250 and VR+ΔR 260 provides hysteresis in the operation of LED 110. Its output will not be adjusted if it is within the window set by these two reference levels.

In the embodiment described, the output of green LEDs 120 is not tracked, but instead is set by DAC 380 which feeds driver 390, controlling green LEDs 120. The overall intensity of the device is controlled through setting the green level, since the output of the red and blue LEDs will track in a ratiometric manner.

The blue channel operates in a manner similar to the red channel previously described. Red photodiodes 150*a, c* feed integrator 410. Integrator 410 feeds window comparators 430 and 440, which compare the output voltage of integrator 410 representing the blue light flux to reference levels VB 450 and VB+ΔB 460. The outputs of comparators 430 and 440 control up/down counter 470, which feeds DAC 480 and driver 490 to control blue LEDs 130.

By performing intensity measurements and adjustments over several measure integrate —compare —correct cycles, changes are made in a gradual manner.

In this design, state information is held in the values of counters 270, 370, 470. For more efficient startup, control circuitry would preserve the values of these counters across power cycles, restoring the counters to their last operating values as a good first approximation of starting levels.

The embodiment of FIG. 2 uses linear control to vary the intensity of the LEDs. DACs 280, 380, and 480 generate analog levels feeding drivers 290, 390, and 490, controlling the intensity of LEDs 110, 120, and 130. Essentially, drivers 290, 390, and 490 are being used as variable resistors. This type of arrangement is inefficient, as the voltage dropped across drivers 290, 390, and 490 is turned into heat.

More efficient control is obtained by using switching converters to drive the LEDs. Switching converters are well known in the art, being manufactured by companies such as Texas Instruments and Maxim Integrated Circuits. As is known to the art, in a switching converter, varying pulse width or duty cycle is used to control a switch, producing an adjustable output voltage with very high efficiency. LEDs exhibit relatively high series resistance, so stable control of current is attainable by adjusting the voltage applied to the LED.

The embodiment of FIG. 2 is adapted to use switching converters by using the outputs of the window comparators (230 and 240 for the red channel, 430 and 440 for the blue channel) to control the pulse widths for switching converters driving the LEDs. When a desired level is too low, the corresponding pulse width is increased, increasing he on time of the switching converter, increasing its output voltage, and increasing the corresponding LED current and luminous output. The values of counters 270, 370, 470 may be used to determine pulse width for the switching converters.

Figure 3:
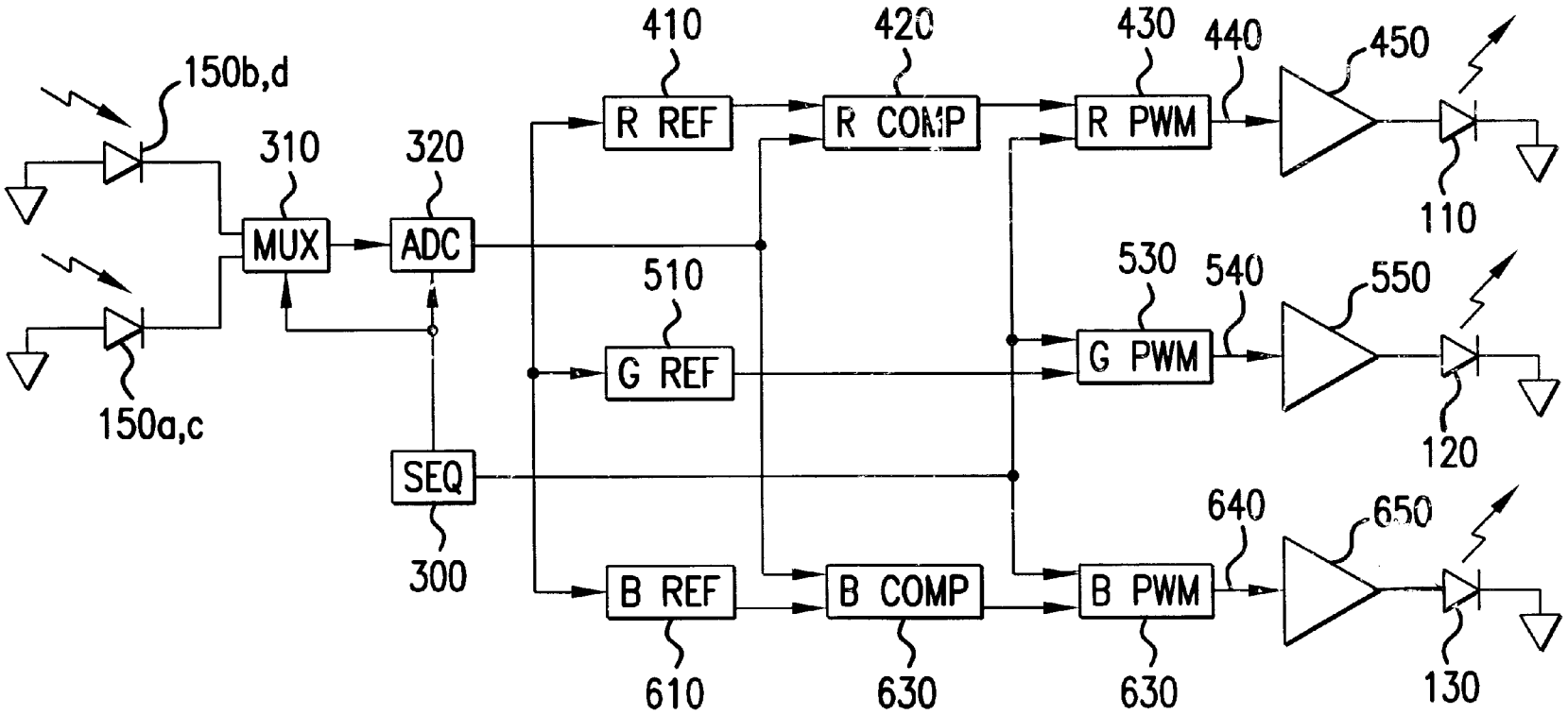
FIG. 3 shows the block diagram of an additional embodiment for the control circuit.

An additional embodiment illustrating these concepts is shown in FIG. 3. Sequencer 300 controls the operation of the device. Multiplexer 310 under control of sequencer 300 selects the output of one of the photodiodes 150*b,d* or 150*a,c*. The output of the selected photodiode is converted to digital form by ADC 320.

Digital reference levels are provided by latches 410 for the red channel, 510 for the green channel, and 610 for the blue channel. The contents of these latches is loaded and updated by circuitry not shown. For the green channel, the output of latch 510 is used to set the pulse width of pulse width modulator 530, producing a pulse width modulated output 540, which is used to drive switching converter 550 to drive the green LEDs 120.

Comparators 420 and 620 compare the output of ADC 320 to reference values 410 and 610, respectively. The results of these comparisons, under control of sequencer 300, are fed to pulse width modulators 430 and 630, for the red and blue channels.

In operation, this embodiment performs much the same as its analog counterpart of FIG. 2. Differences between measured values (320) and desired values (410, 610) are produced by comparators (420, 620) and increase or decrease the pulse width (430, 630) of the corresponding drive signals (440, 640), driving switching converters (450, 650) and LEDs (110, 130).

This embodiment has the advantage over the embodiment of FIG. 2 in that it is completely digital after the initial ADC stage 320. The digital portion of FIG. 3 may be implemented in fixed logic, or in a single-chip microprocessor.

Figure 4:
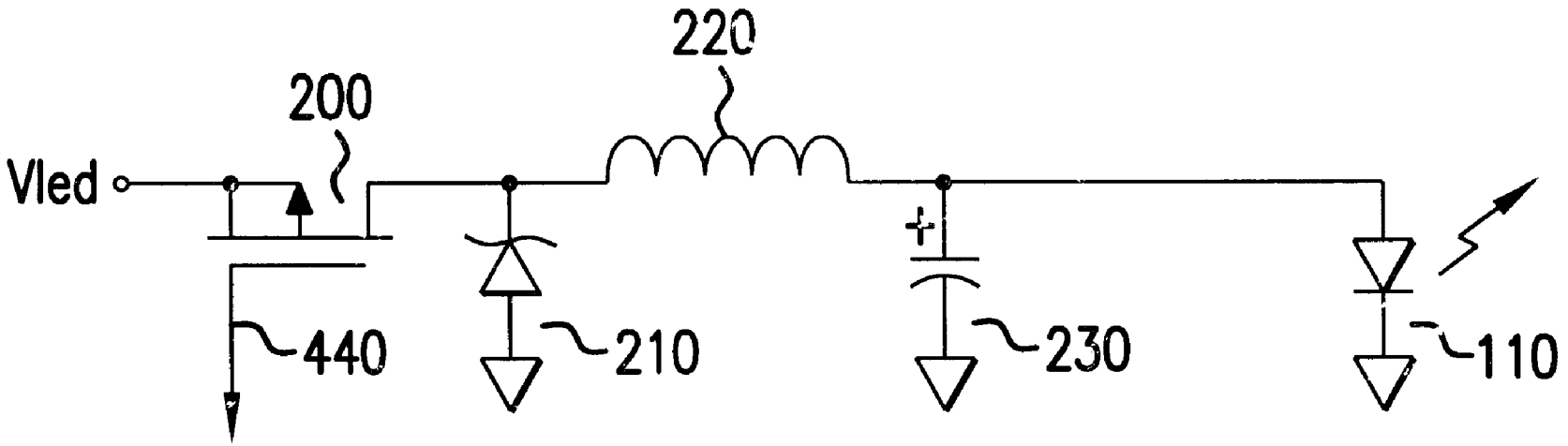
FIG. 4 shows a simple switching converter.

FIG. 4 shows a simple switching converter, here a step-down converter for use when the LED supply voltage (Vled) is higher than the voltage applied to the LEDs. Other topologies known to the art may be used to provide a boosted LED voltage if needed by the particular implementation without deviating from the spirit of the current invention. Pulse width modulated drive signal 440 drives the gate of MOS switch 200. When switch 200 is turned on, voltage is applied across inductor 220, causing current to flow through the inductor. When switch 200 is turned off, current continues to flow in inductor 220, with the circuit completed by catch diode 210, preferably a Schottky diode. The voltage across LED 110 is smoothed by capacitor 230. The voltage across LED 110 is proportional to the on-time of switch 200, and therefore the pulse width of drive signal 440.

The foregoing detailed description of the present invention is provided for the purpose of illustration and is not intended to be exhaustive or to limit the invention to the precise embodiments disclosed. Accordingly the scope of the present invention is defined by the appended claims.

What is claimed is:

1. A solid state illumination device for producing a predetermined spectral distribution comprising:

a plurality of light emitting diodes of different colors, a photosensor measuring incident light from the light emitting diodes, the light emitting diodes and photosensor connected to a control circuit comprising:

a plurality of driver means, each driver means driving one or more light emitting diodes of a predetermined color, comparison means for comparing the output of the photosensor with the predetermined spectral distribution, and adjustment means coupled to the comparison means for adjusting the driver means such that the output of the photosensor matches the predetermined spectral distribution.

2. The illumination device of claim 1 where the photosensor is mounted interspersed among the light emitting diodes so as to measure incident light from the light emitting diodes.

3. The illumination device of claim 1 where the photosensor is a photodiode.

4. The illumination device of claim 1 where the driver means is a linear driver.

5. The illumination device of claim 1 where the driver means is a switching converter.

6. The illumination device of claim 1 where the photosensor responds to the light emitted by each of the different color LEDs.

7. The illumination device of claim 1 where the comparison and adjustment means further comprises:

selection means for selecting a single LED color, comparison means for comparing the incident light falling on the photosensor from the LEDs with the predetermined spectral distribution, adjustment means for adjusting the driver for the selected color LEDs such that the output of the selected color LEDs matches the predetermined spectral distribution, and means for repeating the process for the other color LEDs.

8. The illumination device of claim 1 where the photosensor and the light emitting diodes are mounted on a common substrate.

9. A solid state illumination device for producing a predetermined spectral distribution comprising:

a plurality of light emitting diodes of different colors, a plurality of photosensors measuring incident light from the light emitting diodes, the light emitting diodes and photosensors connected to a control circuit comprising:

a plurality of driver means, each driver means driving one or more light emitting diodes of a predetermined color, comparison means for comparing the output of the photosensors with the predetermined spectral distribution, and adjustment means coupled to the comparison means for adjusting the driver means such that the output of the photosensors matches the predetermined spectral distribution.

10. The illumination device of claim 9 where the photosensors are mounted interspersed among the light emitting diodes so as to measure incident light from the light emitting diodes.

11. The illumination device of claim 9 where the photosensors are photodiodes.

12. The illumination device of claim 9 where the driver means is a linear driver.

13. The illumination device of claim 9 where the driver means is a switching converter.

14. The illumination device of claim 9 where the photosensors are divided into groups responsive to different color light emitting diodes.

15. The illumination device of claim 14 where the photosensors are divided into groups such that each group of photosensors responds to a different color light emitting diode.

16. The illumination device of claim 14 where the light emitting diodes produce illumination in lower, middle, and upper wavelengths, and the photosensors are divided into two groups such that a first group of photosensors responds to light emitting diode illumination in lower and middle wavelengths, and a second group of photosensors responds to light emitting diode illumination in upper and middle wavelengths.

17. The illumination device of claim 15 where the comparison and adjustment means further comprises:

means for comparing the output of each group of photosensors with the predetermined spectral distribution, and adjustment means for adjusting the drivers for the associated light emitting diode color for each group of photosensors such that the output of each light emitting diode color matches the predetermined spectral distribution.

18. The illumination device of claim 16 where the comparison and adjustment means further comprises:

means for adjusting the output of the middle wavelength light emitting diodes to a predetermined level, comparison means for comparing the incident light measured by the first group of photosensors responsive to light emitting diode illumination in lower and middle wavelengths with the incident light measured by the second group of photosensors responsive to illumination in middle and upper wavelengths, and adjustment means for adjusting the drivers for the light emitting diodes in the lower and upper wavelengths such that the predetermined spectral distribution is attained.

19. The illumination device of claim 9 where the photosensors and light emitting diodes are mounted on a common substrate.

20. In a solid state illumination device comprising light emitting diodes of different colors and one or more photosensors for sensing incident light from the light emitting diodes, the method of producing a predetermined spectral distribution comprising:

selecting light emitting diodes of a predetermined color, illuminating the selected light emitting diodes, measuring the incident light from the light emitting diodes using the photosensors, comparing the measured incident light to a predetermined spectral distribution, adjusting the output of the selected light emitting diodes so that the incident light measured by the photosensors matches the predetermined spectral distribution, and repeating the process for the light emitting diodes of the remaining colors.

21. In a solid state illumination device comprising light emitting diodes of different colors and one or more photosensors for sensing incident light from the light emitting diodes, the method of producing a predetermined spectral distribution comprising:

dividing the photosensors into groups such that each group of photosensors is responsive to a single light emitting diode color, measuring the incident light of the light emitting diodes using the groups of photosensors, comparing the outputs of the groups of photosensors with the desired spectral distribution, and adjusting the output of the corresponding color light emitting diodes so that the outputs of the groups of photosensors matches the desired spectral distribution.

22. In a solid state illumination device comprising light emitting diodes of lower, middle, and upper wavelengths and photosensors for sensing incident light from the light emitting diodes, the photosensors divided into a first group responding to light emitting diode illumination in the lower and middle wavelengths, and a second group responding to middle and upper wavelengths, the method of producing a predetermined spectral distribution comprising:

adjusting the output of the middle wavelength light emitting diode to match the predetermined spectral distribution, comparing the incident light measured by the first group of photosensors responsive to light emitting diode illumination in the lower and middle wavelengths with the incident light measured by the second group of photosensors responsive to light emitting diode illumination in the middle and upper wavelengths, and adjusting the output of the light emitting diodes in the lower and upper wavelengths such that the desired spectral distribution is obtained.

* * * * *